US005570934A

United States Patent [19]

Szita et al.

[11] Patent Number: 5,570,934

[45] Date of Patent: Nov. 5, 1996

[54] TRACTION BORING DEVICE USING MULTIPLE TREPANS FOR PRODUCING LARGE CUTS IN CONCRETE WORKS AND THE LIKE AND METHOD OF PRODUCING CUTS

[75] Inventors: Peter Szita, Ste-Thér´´se; Louis Dubreuil, St-Didace, both of Canada

[73] Assignee: Hydro-Quebec, Montreal, Canada

[21] Appl. No.: 405,173

[22] Filed: Mar. 16, 1995

[51] Int. Cl.[6] ..... E21C 25/10; E21C 31/04; B28D 1/06

[52] U.S. Cl. ..... 299/15; 125/16.01; 299/41.1

[58] Field of Search ..... 299/15, 38.1, 41.1; 125/12, 13.01, 13.03, 16.01

[56] References Cited

U.S. PATENT DOCUMENTS

| | | | |
|---|---|---|---|
| 207,374 | 8/1878 | Webster | 299/41.1 |
| 3,675,972 | 7/1972 | Slomito | 299/15 X |
| 3,982,521 | 9/1976 | Bieri | 125/16.01 |
| 4,962,967 | 10/1990 | Hinkle | 299/15 X |

FOREIGN PATENT DOCUMENTS

| | | | |
|---|---|---|---|
| 1317136 | 6/1987 | U.S.S.R. | 299/15 |

*Primary Examiner*—David J. Bagnell
*Attorney, Agent, or Firm*—Klauber & Jackson

[57] ABSTRACT

A multiple trepan boring device for producing substantially large cuts in large works, such as concrete dams, comprises a drilling shaft adapted to be translationally displaced along its longitudinal axis and carrying a series of spaced apart cylindrical rotatable trepans each having a peripheral cutting surface and an annular cutting surface, the latter extending in plane perpendicular to the axis of the shaft and radially between the shaft and the peripheral cutting surface. Weights apply continuous downwards forces on the shaft and thus on the trepans. With the trepans resting on the top of the work to be cut, the trepans are rotated in place, and under the aforementioned forces the peripheral cutting surface of each trepan bores a hole until the shaft rests on the top of the work. Then the shaft is displaced translationally while the trepans continue to rotate thereby causing the annular cutting surfaces to remove a layer of the work extending between the shaft and the peripheral cutting surface. This procedure is repeated so as to produce a cut of a width corresponding to the outside diameter of the trepans by successive removal of crescent-shaped layers from the work. After the removal of each layer, the shaft is lowered along a distance corresponding to the difference in radii between the drilling shaft and the trepans.

24 Claims, 8 Drawing Sheets

TRACTION BORING DEVICE USING MULTIPLE TREPANS FOR PRODUCING LARGE CUTS IN CONCRETE WORKS AND THE LIKE AND METHOD OF PRODUCING CUTS

BACKGROUND OF THE INVENTION

1. Field of the Invention

The present invention relates to devices for producing cuts in concrete works, such as dams, and, more particularly, to a traction boring device adapted to produce large cuts typically by way of a multiple trepan assembly.

2. Description of the Prior Art

It is well known to use in stone-pits for various sawing activities cutting cables set with diamonds, otherwise known as diamond-set cutting cables. Such cutting cables have been modified to produce cuts in large concrete dams and this technique is generally described in U.S. patent application No. 08/031,465 filed on Mar. 15, 1993 now U.S. Pat. No. 5,449,248 which discloses such a cutting cable set with diamonds which forms an endless loop positioned so as to surround the section of the dam where a cut of substantially uniform width (10 to 15 mm wide) is desired. The cable is motor driven so as to be driven in translation around the dam. The cable is pressure loaded so as to exert inwardly thereof pressure on the dam whereby the displacement of the cutting cable causes the dam to be cut inwardly from its periphery typically until the aforementioned section of the dam has been completely cut in half.

There exist other methods for producing cuts in large concrete works such as the boring of a series of parallel successive and transversally overlapping holes which extend along one dimension of the concrete work with the cut being completed in the other direction thereof by the side-by-side and overlapping configuration of the successive holes so bored. This cutting method is also described and illustrated in the previously cited U.S. Patent Application. Obviously, such a cutting technique is time consuming and does not produce a cut of uniform width although larger width of cuts can be obtained with this technique than with the afore-described diamond-set cutting cables.

SUMMARY OF THE INVENTION

It is therefore an aim of the present invention to provide a novel device for producing cuts in large works, such as dams, in a substantially efficient way.

It is also an aim of the present invention to provide a novel device for producing large cuts of substantially uniform width in large concrete works, such as dams.

It is a further aim of the present invention to provide a novel device for producing large cuts using a traction-driven boring head.

It is a still further aim of the present invention to provide a novel traction boring device for producing large cuts in large concrete works, wherein the boring device has multiple spaced apart and coaxial trepans or drilling bits.

Therefore, in accordance with the present invention, there is provided a boring device for producing cuts in large works, such as concrete dams, comprising a drilling shaft, a motor means for rotatably driving said drilling shaft, at least one trepan means mounted on said drilling shaft and adapted for rotation therewith, said drilling shaft and said trepan means being adapted to be translationally displaced along a rotational axis thereof, said drilling shaft and said trepan means being positioned in use on a large work to be cut and opposite a location of a cut to be produced by said device, pressure exerting means acting on said drilling shaft and said trepan means in direction of the large work and of said cut, said trepan means being of transverse dimensions greater than said drilling shaft and including cutting means extending outwardly of said drilling shaft and in a plane substantially perpendicular to said axis, whereby said drilling shaft and said trepan means while being rotated by said motor means can be translationally displaced along said axis such that said cutting means removes a layer means from the large work of a width substantially corresponding to outside transverse dimensions of said cutting means and of a maximum thickness at most equal to a distance between said drilling shaft and said outside transverse dimensions of said trepan means.

Also in accordance with the present invention, there is provided a method for producing cuts in large works, such as concrete dams, comprising the steps of:

a) positioning a rotatable assembly consisting of a drilling shaft and at least one trepan means mounted on said drilling shaft on a large work and opposite a location of a desired cut such that a cutting means of said trepan means extending outwardly of said drilling shaft and in a plane substantially perpendicular to a rotational axis thereof with at least part of said cutting means being located opposite the work to be cut;

b) displacing in translation along said axis said drilling shaft and said trepan means while in rotation and while exerting some pressure thereon in direction of the large work and of said cut such that said cutting means removes a layer means from the large work of a width substantially corresponding to outside transverse dimensions of said cutting means and of a maximum thickness at most equal to a distance between said drilling shaft and said outside transverse dimensions of said cutting means; and c) repeating steps a) and b) until a cut of desired depth is obtained by removal one-by-one of a number of layers.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Prior art cutting devices such as the aforementioned cutting cable set with diamonds can produce in works such as large concrete dams cuts which are approximately 12 mm wide and which can generally reach at most a width of 16 mm. On the other hand, there is sometimes a need for larger cuts, e.g. in the range of 30 to 60 mm and even up to 100 mm.

In accordance with the present invention, a particularly advantageous method of producing a cut in a large concrete work operates on the basis of a device having a rotatable drilling bit mounted on a drilling shaft which is displaced axially in a reciprocal translational motion and which is used in traction to produce the cut. Indeed, a drilling bit driven in traction substantially prevents any deviation in the drilling head, whereas the drilling head could be subject to all sorts of radial deviations if the drilling head was being pushed by the drilling shaft along the concrete work to produce the desired cut therein.

Figure 1:
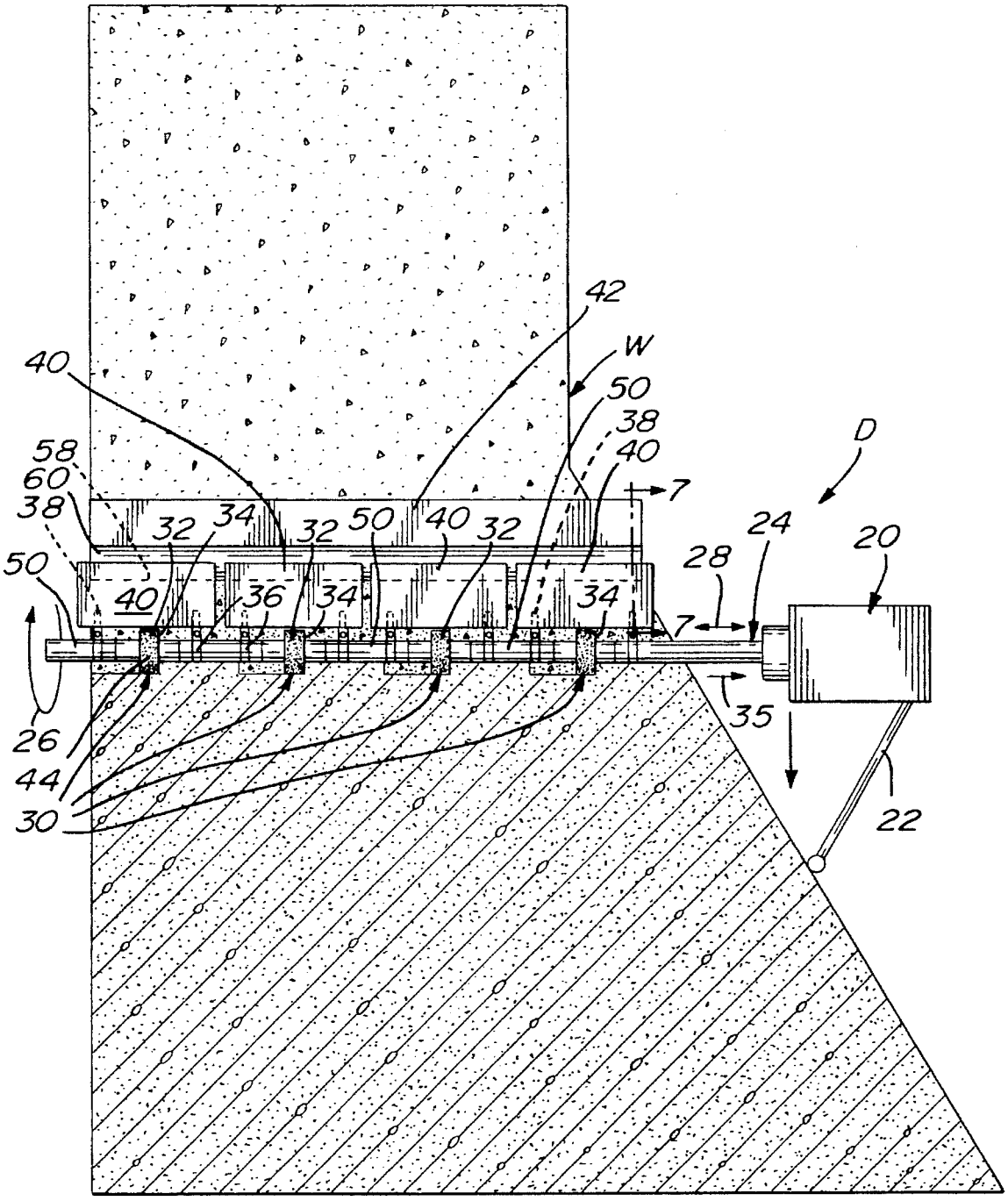
FIG. 1 is a cross-sectional elevational view of a multiple trepan traction boring device in accordance with the present invention shown in position on a large concrete dam while in the process of producing a large cut therein.

Accordingly, FIG. 1 illustrates a boring device D in use on a large concrete work W, such as a concrete dam, for producing a substantially large vertical cut therein. Generally, the boring device includes a motor driven drill rotatably driving a drilling shaft which can further be translationally axially displaced. A drilling bit or trepan is secured to the drilling shaft for rotation therewith. The trepan comprises a drilling surface positioned in a plane perpendicular to the axis of rotation of the drilling shaft so as to cut through the concrete work when the trepan is operated under traction, i.e. when the drilling shaft is translationally displaced towards the motor driven drill. The trepan has a diameter larger than that of the drilling shaft, whereby it can remove, one by one, layers of the concrete work of a thickness corresponding to a differential between the radii of the trepan and of the drilling shaft. The trepan must thus be translationally and longitudinally displaced along the complete dimension of the section of the concrete work being cut that is parallel to an axis of the drilling device. Therefore, by including a series of axially spaced apart trepans on the drilling shaft, the path of the drilling shaft and thus of each trepan can be reduced as all of the trepans work simultaneously on a same layer of the concrete work being cut.

Accordingly, in a general embodiment of the boring device in accordance with the present invention, which on the other hand is not herein illustrated, the drilling shaft carrying the trepan is positioned substantially horizontally on the concrete work to be cut and the trepan is positioned at a furthermost position with respect to the motor driven drill and outwardly of the concrete work, whereby the elongated shaft lies supported on the concrete work, i.e. the depth of the concrete work extends between the trepan and the motor driven drill. Then, the trepan is rotated by way of the shaft driven by the drill and the trepan is gradually pulled towards the drill so that the boring surface thereof located below the drilling shaft and facing the drill removes a layer of the concrete work corresponding to the difference in radii between the cylindrical trepan and the drilling shaft. A system of weights is typically applied on the drilling shaft so that the latter remains in contact with the concrete work thereby preventing the boring device from lifting and thus maintaining the trepan in working contact with the concrete work.

If the cut is to be defined on only a section of a concrete dam and, more particularly, on a portion of the depth thereof, a vertical hole is first bored with known techniques through the concrete dam at a location thereon corresponding to the upstream end of the intended cut that is the end thereof that is located furthest from where the motor driven drill will be positioned. Accordingly, the trepan can first be positioned in this vertical hole with the drilling shaft extending between the trepan and the drill and thus on the section of the concrete dam to be cut.

Advantageously, and as illustrated in FIG. 1, the drilling shaft carries a series of preferably identically spaced apart trepans so as to allow for a shorter travel of the drilling shaft with this travel corresponding basically to the distance between each trepan. Indeed, each trepan will remove part of a layer of the concrete work with the plurality of trepans removing in concert a complete layer thereof. If a plurality of trepans are used, a number of vertical holes must be previously bored so as to receive each trepan in its original position (i.e. upstream end of travel position) which corresponds to a position thereof which is furthest from the motor driven drill. By having a plurality of trepans, the speed of the boring device is increased as, if there are for example five trepans, the travel of the drilling shaft is reduced five times, whereby each layer of the concrete work is removed five times quicker than if only one trepan were to be used. On the other hand, the boring of the vertical holes constitutes a delicate and time-consuming additional step which, in the illustrated embodiment of the present invention described hereinbelow, has been removed by modifying the trepans so that they can bore themselves their downward vertical way in the concrete work. With such a system, the trepans are first rotated to each remove a section of the concrete work of a height corresponding to the difference between the radii of the trepans and that of the drilling shaft, i.e. until the drilling shaft rests on the concrete work. This is obviously achieved without translationally displacing the trepans. Once the drilling shaft overlies the concrete work (whereby the trepans have bored their own vertical downward way in the concrete work), the trepans can, while being rotated, be translationally displaced in traction towards the motor driven drill so as to remove the remainder of the layer of the concrete work extending between the trepans. These two steps are repeated for each layer removed from the concrete work until the desired complete cut is achieved.

Figure 2:
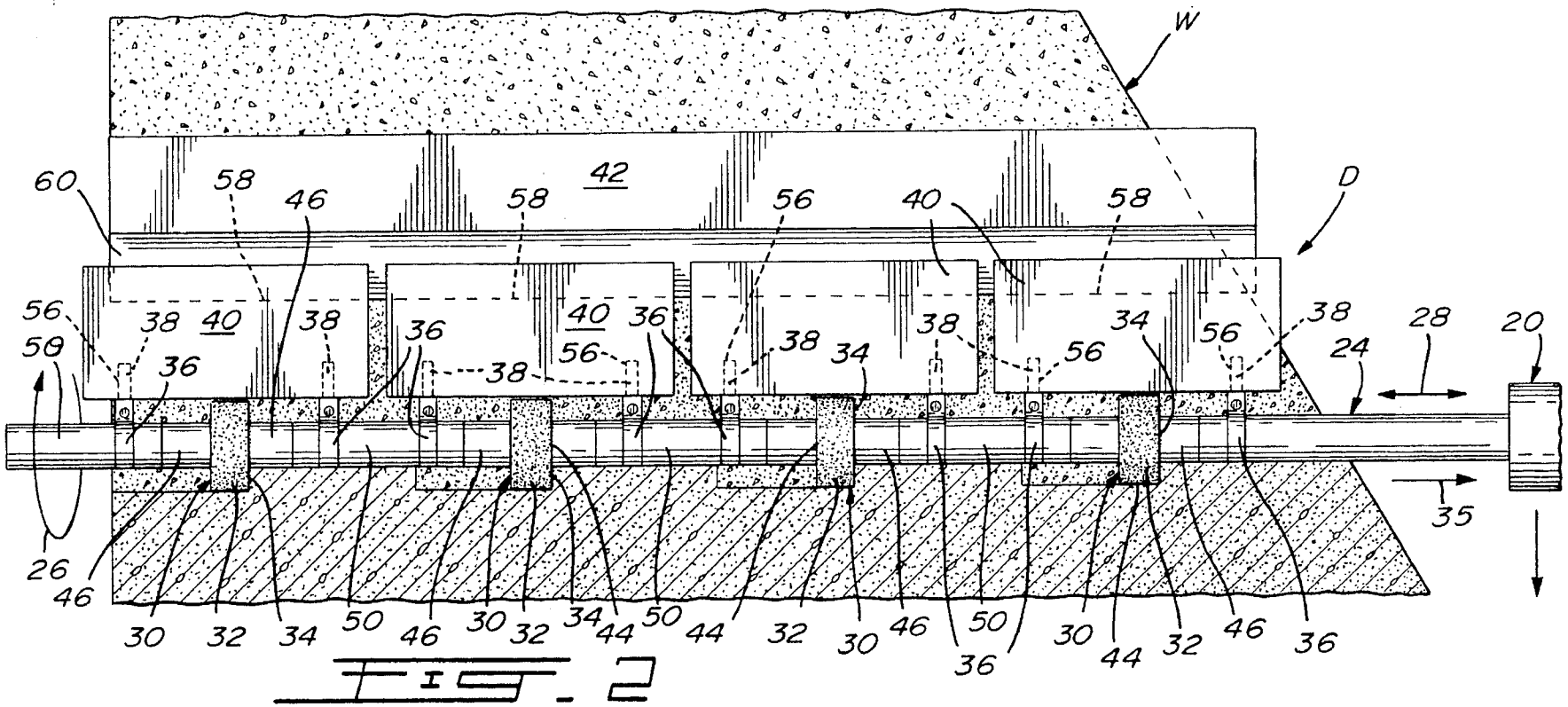
FIG. 2 is an enlarged elevational view of part of the traction boring device of FIG. 1.

Accordingly, now referring mainly to FIGS. 1 and 2, the boring device D of the present invention comprises a motor driven drill 20 supported on the downstream side of the concrete work or dam W by a suitable support 22. The motor driven drill 20 is adapted to rotatably drive an elongated drilling shaft 24 along arrow 26 (see FIGS. 1 and 2). Furthermore, the drill 20 can translationally displace the drilling shaft 24 along arrows 28 of FIGS. 1 and 2. The drilling shaft 24 carries a series of spaced apart trepans 30 which are adapted to rotate with the drilling shaft 24. Each trepan 30 is disc-shaped and includes a continuous peripheral cutting surface 32 and an inner annular cutting surface 34 extending transversally to a longitudinal axis of the drilling shaft 24 while facing towards the motor driven drill 20 so that when the boring device D is used in traction (as per arrow 35 in FIGS. 1 and 2), the annular cutting surface 34 will cut through a layer of the concrete work W. Both the cutting surfaces 32 and 34 are set with diamonds.

For illustration purposes, the diameter of the trepans 30 can be of 60 mm with the drilling shaft 24 having an outside diameter of 30 mm, whereby the boring device D will remove a layer of approximately 15 mm in height from the concrete work W, that is the difference between the radii of the trepans 30 and of the drilling shaft 24. The distance between the trepans 30 can be approximately from 300 to 900 mm (1 to 3 feet).

Still referring mainly to FIGS. 1 and 2, a series of bushings 36 are mounted in a spaced apart way around the drilling shaft 24 with each bushing 36 comprising an upwardly extending rod 38. The rods 38 support a series of weights 40 distributed longitudinally above the drilling shaft 24. A weight stabilizer and guide 42 is disposed above the series of weights 40, as best seen in FIG. 1. Therefore, the drilling shaft 24 will rotate within the bushings 36 which remain immobile while supporting the weights 40 and the weight stabilizer and guide 42.

With reference to FIG. 1, it is noted that the drilling shaft 24 is made of a plurality of separate sections which are end-fitted in the trepans 30, whereby the trepans 30 act as connecting members for each two axially successive sections of the drilling shaft 24. Therefore, additional shaft sections 50 and trepans 30 can be added if, as the cut extends gradually downwards, the depth of the concrete work increases, as it is the case in the concrete dam w illustrated in FIGS. 1 and 2.

The motor driven drill 20 and, more particularly, the drilling shaft 24 thereof will carry a maximum number of trepans 30 while maintaining the efficiency of the boring device D in view of the particular application on which it is being used. In some instances, the boring device D can be used to produce cuts in materials other than concrete, such as rocks or even metallic structures, e.g. piping and reinforced concrete.

It is noted that the vertical displacement of the boring device D and, more particularly, of the motor driven drill 20, along the downstream face of the concrete dam W can be insured by a rack and pinion assembly or by an endless screw. The traction, that is the translational displacement of the drilling shaft 24 and of the trepans 30 carried thereby towards the motor driven drill 20 during the boring operations can be achieved also by a rack and pinion assembly or even by a hydraulic system.

It is further noted that the direction of rotation of the drilling shaft 24 and thus of the trepans 30 is alternated during the cutting operation in order to maintain the resulting cut as vertical and straight as possible. Also, the cut is often achieved with the drilling shaft 24 extending at a slight angle with respect to the horizontal, Such as a 4 or 5 degree angle, in order to facilitate the evacuation of the concrete chips gradually removed from the concrete work W during the cutting operation.

Figure 3:
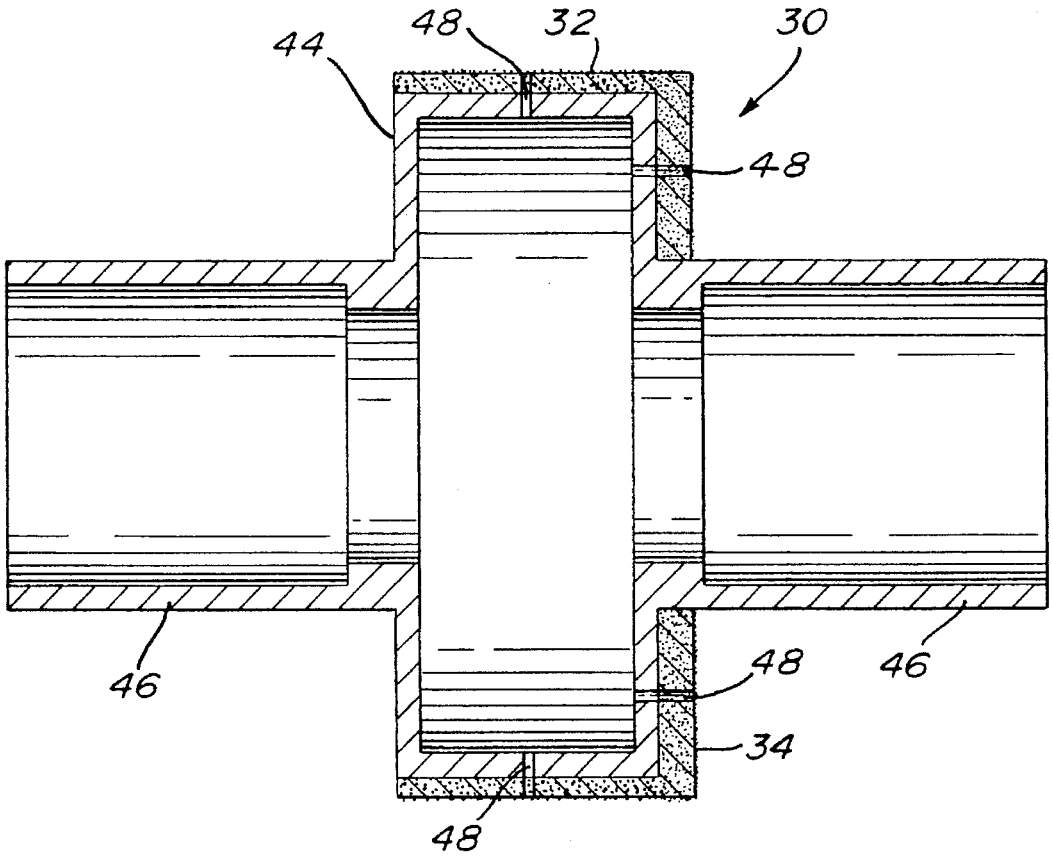
FIG. 3 is an enlarged detailed elevational view of a typical -boring trepan of the traction boring device of the present invention.

Now referring to FIG. 3 which is an enlarged detailed view of the trepan 30, it is seen that the trepan 30 comprises a central disc-shaped drilling head 44 and a pair of cylindrical end connection members 46 on each side of the drilling head 44. As mentioned hereinabove, the peripheral surface of the drilling head 44 includes the diamond-set cutting surface 32, whereas the side annular surface of the drilling head 44 which faces towards the motor driven drill 20 includes the diamond-set cutting surface 34. Openings 48 are defined through the drilling head 44 at the cutting surfaces 32 and 34 thereof to allow water supplied in the drilling shaft 24 for cooling, cleaning and lubricating purposes to exit the drilling shaft 24 at the drilling heads 44 and thus at the areas of boring.

The end connection members 46 are adapted to be attached to the end of the individual shaft sections 50 of the drilling shaft 24 typically by way of spring pins or by the engagement of cooperating threads which is further fixed by a spring pin. Normally, threads are not sufficient to provide an appropriate engagement of the trepans 30 with the sections of the drilling shaft 24 since the drilling shaft 24 is rotated in both clockwise and counterclockwise directions.

The cutting surfaces 32 and 34 are typically set with diamonds so as to obtain an appropriate boring action of the trepans 30 on the concrete work W in which a cut is being defined by the present boring device D.

It is noted that the other annular side surface of the drilling head 44, located opposite the cutting surface 34 and thus on the side of the drilling head 44 located furthest from the motor driven drill 20, can also be adapted as a cutting surface by being appropriately set with diamonds so as to allow for the possibility that the boring device D be used to cut the concrete work W while the drilling shaft 24 and trepans 30 are being displaced away from the motor driven drill 20. In such a case, the cutting operation would be done with the drilling shaft 24 and the trepans 30 carried thereby being pushed away from the drill 20 as opposed to the afore-described traction-based cutting action. Such a compression boring could be functional in some applications. On the other hand, to obtain a more efficient two-way cutting action from the boring device D, a system could be used so that the drilling shaft 24 and the trepans 30 become also traction driven even when moving away from the motor driven drill 20, and such a system is proposed in FIGS. 10 and 11 which will be described in detail hereinbelow.

Figure 4:
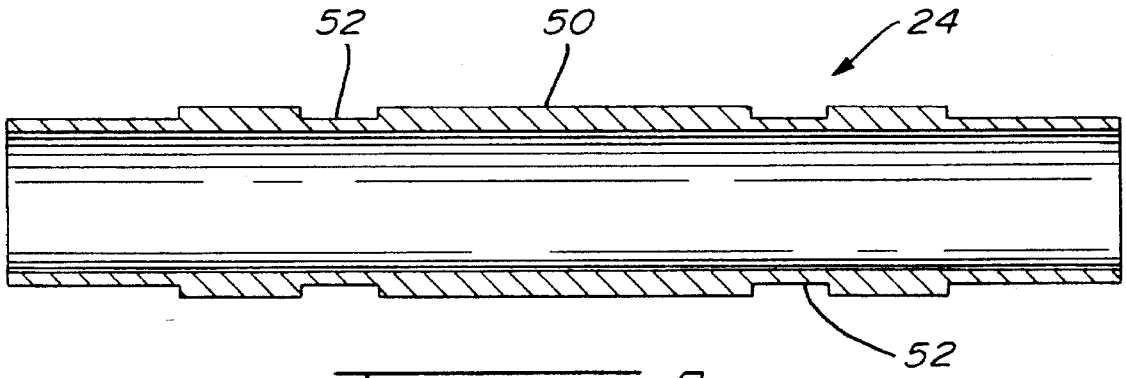
FIG. 4 is an enlarged detailed elevational view of a trepan carrying section of a drilling shaft of the traction boring device of the present invention.

FIG. 4 illustrates a section 50 of the drilling shaft 24 with one such section 50 being provided between each pair of trepans 30, as best seen in FIG. 2. The sections 50 are hollow so that water can be supplied as a coolant, cleaner and/or lubricant through the drilling shaft 24 and the trepans 30. It is noted that polymers can be added to the water in order to improve the lubrication qualities thereof depending on the application of the boring device D. It is further noted that water can also be supplied exteriorly of the drilling shaft 24 if the flow capacity thereof is insufficient in view of the application of the boring device D. The shaft sections 50 which are made of steel each define a pair of peripheral annular grooves 52 adapted to receive therein annular sections 54 of the bushings 36. As mentioned hereinabove, the ends of the shaft sections 50 are adapted to be secured to the end connection members 46 of the trepans 30. The height of the grooves 52 is maximized so that the bushings 36 remain vertical while thus reducing substantially the wear of the bushings 36 as the bushings 36 wear out rapidly if they define an angle with respect to a plane perpendicular to the axis of the shaft sections 50. Furthermore, the bushings 36 are made of bronze so that they wear out instead of the drilling shaft sections 50, the bushings 36 being less expensive to replace than the sections 50 of the drilling shaft 24. The maximal depth of the grooves 52 can be, for example, of approximately 0.25 inch. The width of the grooves 52 and of the annular sections 54 of the bushings 36 (i.e. the dimension thereof taken along the longitudinal direction of drilling shaft 24) can typically be one (1) inch.

Figure 7:
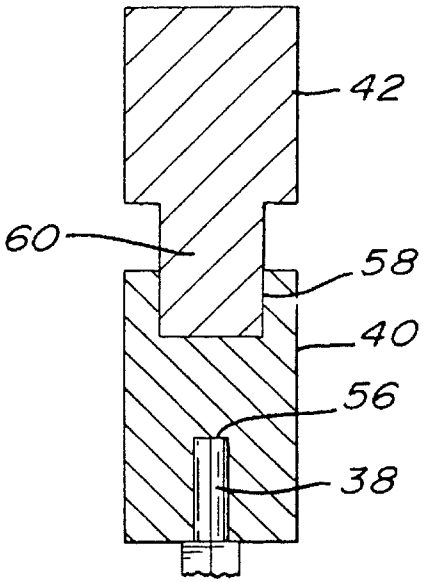
FIG. 7 is an enlarged cross-sectional view taken along lines 7—7 of FIG. 1 and showing the weight and the weight stabilizer of FIG. 2.
Figure 6:
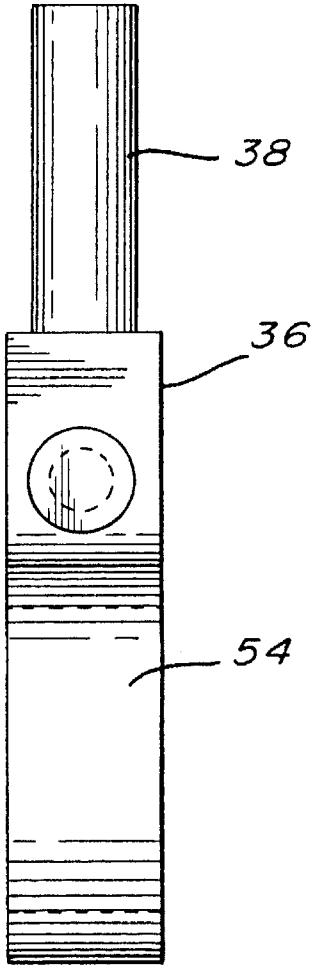
FIG. 6 is a front elevational view of the bushing of FIG. 5.
Figure 5:
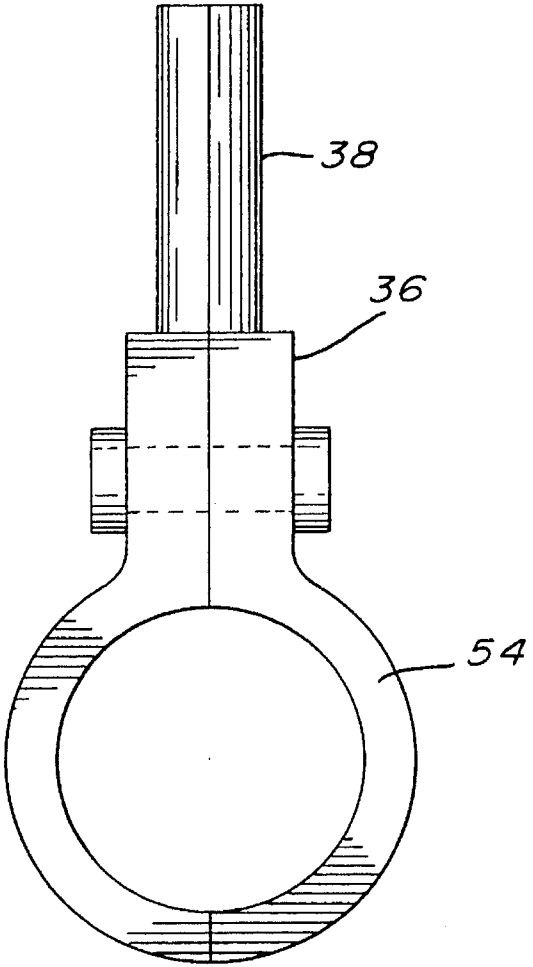
FIG. 5 is an enlarged detailed side elevational view of a bushing of the traction boring device of the present invention.

FIGS. 5 and 6 illustrate in detail one of the bushings 36, including the lower annular section 54 thereof which has a thickness of 0.25 inch and the upper rod 38 which extends upwardly therefrom. With reference to FIGS. 1, 2 and 7, the rods 38 of the bushings 36 are lodged in corresponding vertical holes defined on the underside of the weights 40. The upper surface of each weight 40 defines throughout a longitudinal rectangular channel 58 which receives therein a lower end 60 of the weight stabilizer and guide 42. Therefore, the weight stabilizer and guide 42 which has its lower end 60 lodged in all of the channels 58 of the various weights 40 maintain the weights 40 in an aligned relationship above the drilling shaft 24. Obviously, both the weights 40 and the weight stabilizer and guide 42 are of a width smaller than-that of the cut being defined in the concrete work W so as to gradually lower therein with the drilling shaft 24 and trepans 30 as layers are removed one by one from the concrete work W downwardly opposite the cut. Ultimately, the width of the weights 40 and of the weight stabilizer and guide 42 is identical to that of the cut so as to further act as a guide for the drilling shaft 24 and trepans 30.

Figure 8:
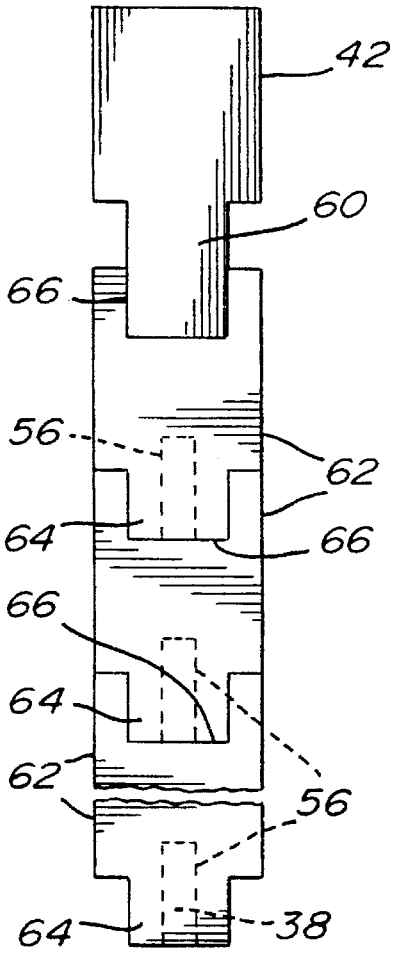
FIG. 8 is a schematic side view of a series of modified weights also in accordance with the present invention, wherein the weights are modular and stackable.

As seen in FIG. 8, the weight 40 can be modified into a modular weight 62 which is designed so that two or more such weights 62 can be stacked one on top of the other and maintained in an engaged position by the cooperation of a lower tongue 64 and an upper groove 66. The lower tongue 64 defines the vertical holes 56 for receiving therein the rods 38 of the bushings 36 in the case of the lowermost modular weight 62 of a stacked assembly of such modular weights 62.

As mentioned hereinbefore, the side annular cutting surfaces 34 of the drilling head 44 of the trepans 30 are adapted to cut through the concrete work W as the drilling shaft 24 and the trepans 30 are being displaced in translation, obviously while also rotating. On the other hand, the peripheral cutting surface 32 is used to vertically downwardly cut through the concrete work W at the beginning of the boring of a new layer therein. Indeed, once a full layer has been removed, it becomes necessary to form initial recesses in the next layer of the concrete work W for receiving the various drilling heads 44 until the drilling shaft 24 rests on the concrete work w. This is achieved by rotating the drilling shaft 24 and the trepans 30 without translationally displacing the same until the peripheral cutting surfaces 32 of the trepans 30 have cut downwardly into the concrete work W for a distance corresponding to the difference in the radii of the drilling heads 44 and the drilling shaft 24, whereat the drilling shaft 24 becomes supported by the concrete work w. Then, the drilling shaft 24 and the trepans 30 are further rotated while, this time, being displaced translationally in traction towards the motor driven drill 20 to remove the layer of concrete located horizontally opposite the original just described recesses defined by the peripheral cutting surfaces 32 of the trepans 30.

The weights 40 exert a downward pressure on the drilling shaft 24 and the trepans 30 at the beginning of the longitudinal travel thereof, i.e. during the vertical boring of the concrete by way of the peripheral cutting surfaces 32 of the trepans 30. Indeed, the weights 40 assist the trepans 30 in the vertical boring which takes place initially for each next layer of concrete along a vertical distance equivalent to the layer which will be then horizontally removed and which corresponds to the aforementioned difference in radii. Furthermore, during the longitudinal boring of the concrete by way of the translational displacement of the trepans 30 and the cutting action of the annular cutting surfaces 34 thereof, the weights 40 exert sufficient downward pressure to ensure that the drilling shaft 24 remains in contact with the concrete of the previous layer that was removed from the concrete work W and thus that the trepans 30 are actually longitudinally cutting through the concrete of the present layer being worked on. It is noted that the weights 40 are function of the size of the trepans 30.

Figure 9:
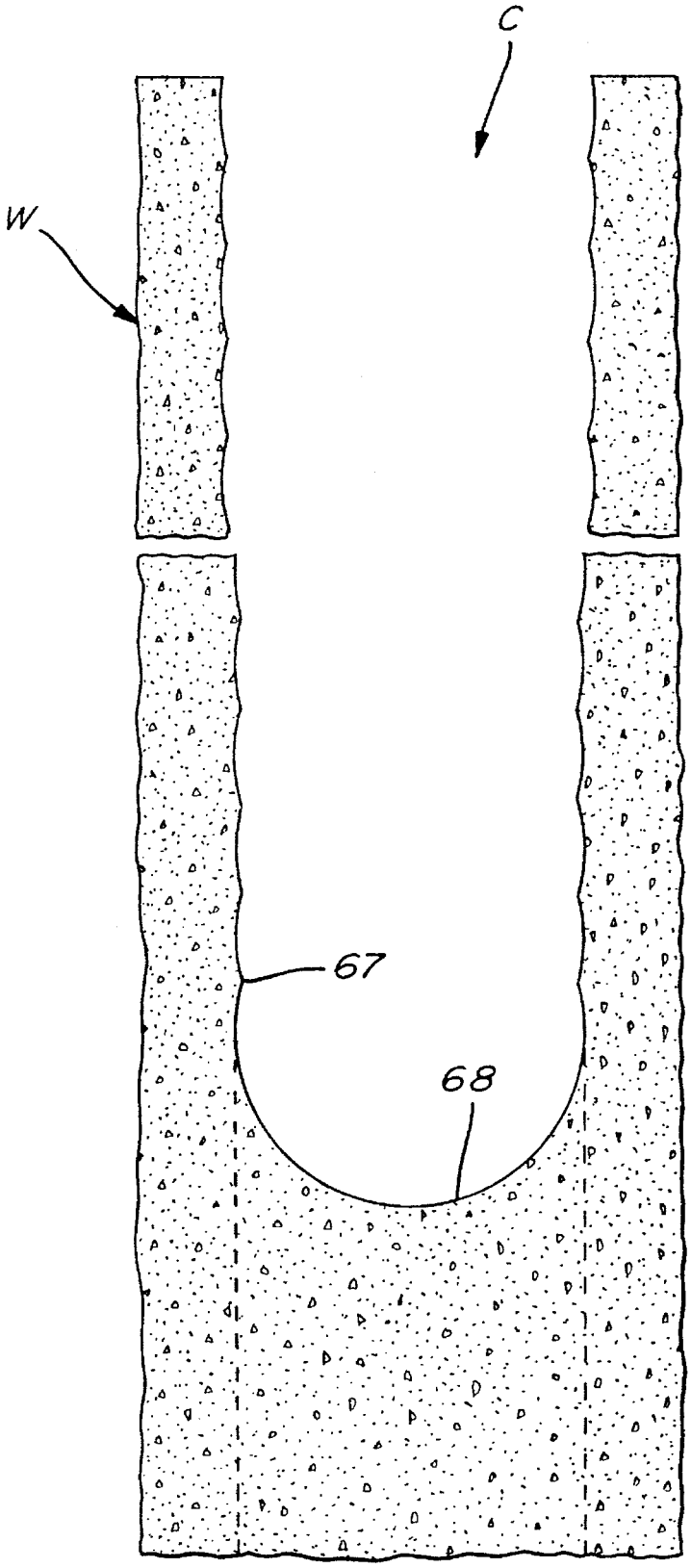
FIG. 9 is an enlarged detailed side elevational view of a partial cut defined in the dam, wherein the cut tapers slightly from top to bottom and wherein the bottom of the partial cut has been reamed.

It is noted that the diameter of the drilling heads 44 gradually slightly reduces because of wear, whereby the cut defined in the concrete work W can have a width which tapers slightly towards its bottom, as illustrated in FIG. 9. Therefore, it becomes sometimes necessary to replace the trepans 30 and thus the drilling heads 44 while working on a same cut. In doing so, a narrower lower end 67 of a cut c can be reamed by boring a horizontal circular hole 68 at the lower end 67 of the cut C of a diameter at least as large as the outside diameter of the new trepans 30. The hole 68 is reamed by replacing on the drilling shaft 24 the trepans 30 with a conventional drilling bit. Then, the boring device D and, more particularly, the drilling shaft 24 and the new trepans 30 installed thereon are reintroduced in the cut C at the level of the hole 68 which has been horizontally bored by the reaming machine and the cut can be continued using the boring device D. It is noted that the minimal width of such a tapering cut C must be at least as large as the width of the weights 40 and of the weight stabilizer and guide 42.

With the present boring device D, there can be created in concrete dams cuts larger than those presently produced by a cutting cable set with diamonds. This allows a larger expansion joint to be produced in the concrete dam W. As mentioned previously, such larger joints were, for instance, previously produced by successive borings done vertically one by one and side by side with some transversal overlap. Such successive borings are very slow and costly. Therefore, the boring device D reduces the necessary time to produce an appropriate large cut C in a concrete dam W and thus also reduces the costs associated with such an operation. Furthermore, with respect to conventional diamond-set cutting cables, the present boring device D allows for the production of a cut which is wider while also increasing the speed of the cutting operation.

Figure 10:
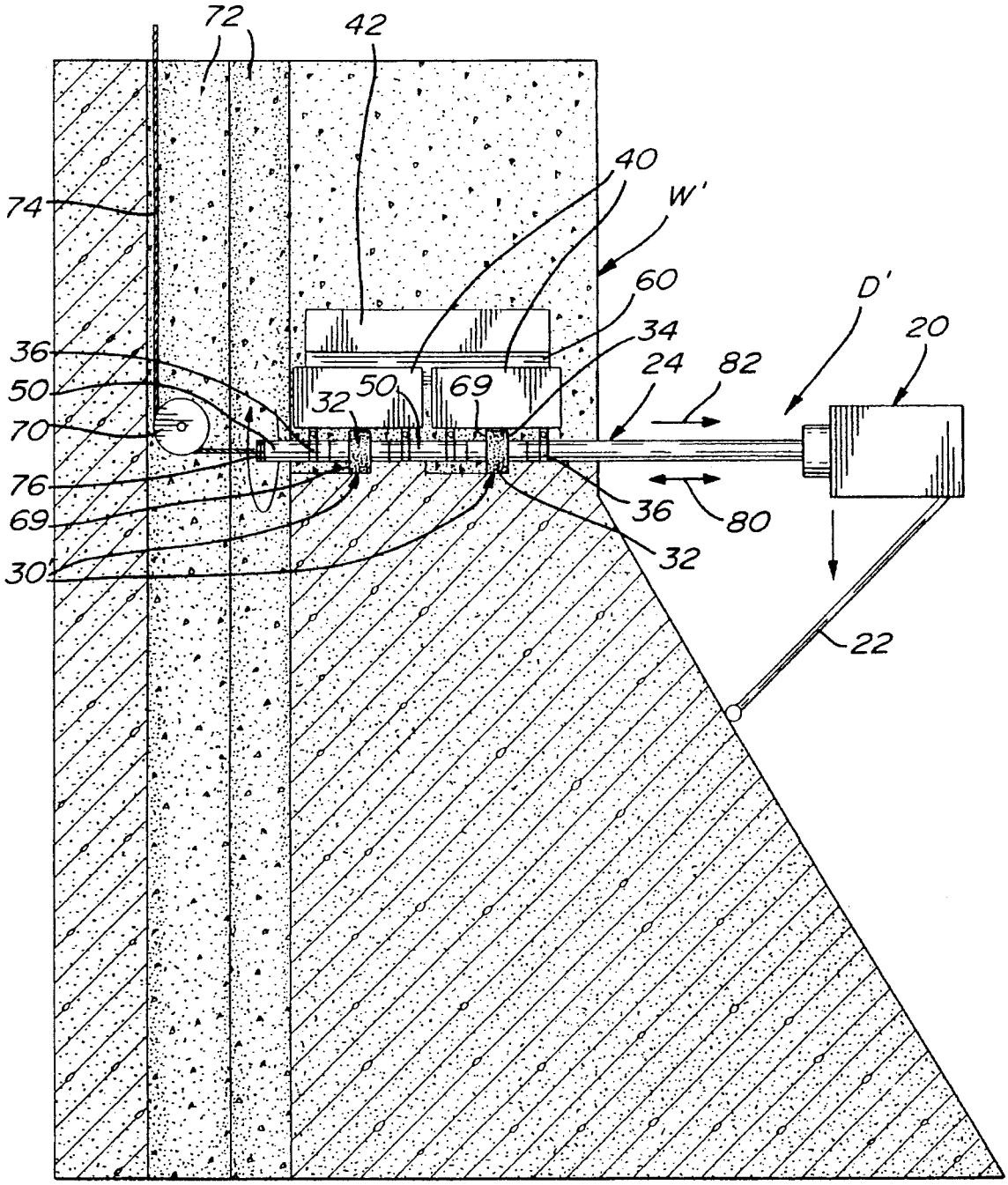
FIG. 10 is a cross-sectional elevational view of a variant dual-direction traction boring device also in accordance with the present invention and shown in use in direct-traction for producing a cut in a concrete dam.
Figure 11:
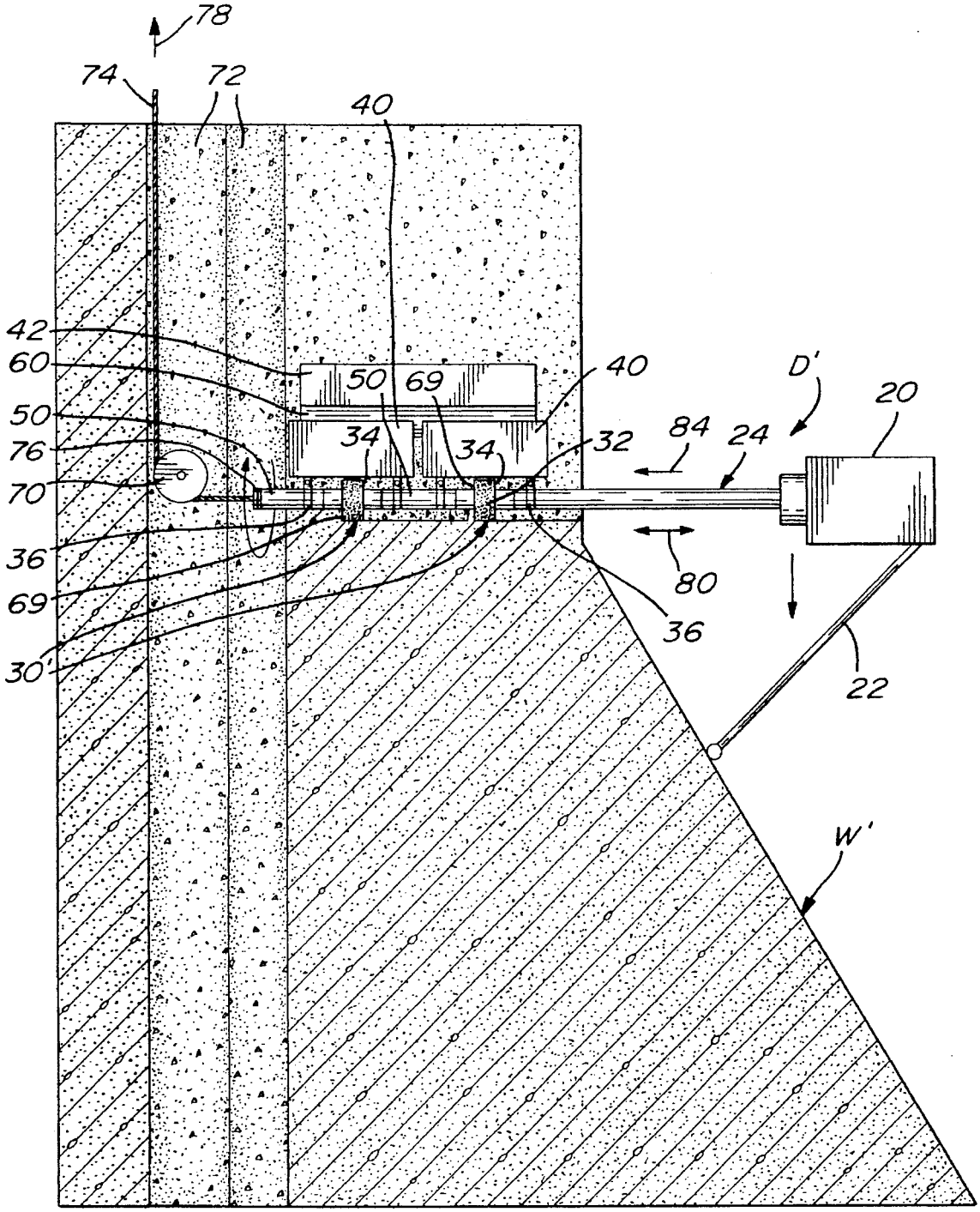
FIG. 11 is a cross-sectional elevational view similar to FIG. 10 but showing the variant traction boring device operating in reverse traction on the concrete dam.

Now referring to FIGS. 10 and 11, there is shown a modified boring device D' also in accordance with the present invention and which comprises a system which allows the boring device D' to also cut layers from the concrete work W while the trepans 30 are being displaced in a direction opposite the motor driven drill 20 thereof. This system which will be described in detail hereinafter can be used if the trepans 30 are disposed closely enough and if the drilling shaft 24 and the individual sections 50 thereof are of sufficiently large dimensions. In such a case, the boring device D' is not only used in traction but also in compression (i.e. in a pushing action). This will allow for layers to be cut from the concrete work w in all translational displacements of the drilling shaft 24 and of the trepans 30 carried thereby instead of having only a drilling action when these components are displaced in traction towards the drill 20, as is the case in the boring device D Of FIGS. 1 and 2. In FIGS. 10 and 11, there are used modified trepans 30' each having both the opposite annular side surfaces of the drilling heads 44' thereof set with diamonds, that is the inner annular surface 34 and an outer annular surface 69 are both diamond-set, so that the trepans 30' can also cut through the concrete when compression driven.

To improve the efficiency of such a back-and-forth cutting, it is preferable to replace the pushing or compression translational displacement by a further traction driven cutting operation by using, for instance, a pulley located upstream of the cut and engaged by a cable which pulls on the boring device D' in a direction opposite that of the conventional traction translational displacement of the drilling shaft 24 and trepans 30' of the boring device D previously described.

With reference to FIGS. 10 and 11, there is shown a rotatable pulley 70 provided in vertical holes 72 defined upstream of the cut being defined in a concrete work w'. The concrete work w' shown in FIGS. 10 and 11 with its vertical holes 72 illustrates a variant of the concrete work W of FIGS. 1 and 2 in that, as opposed to the concrete work W which is shown as being cut completely in half (i.e. along the entire depth thereof), only a section of the concrete work W' (e.g. a downstream section as illustrated) is being cut in half, whereby the vertical holes 72, or an equivalent thereto, are required at the upstream end of the intended cut. The pulley 70 is pivotable for alignment purposes. A cable 74 is engaged around the pulley 70 and is secured to the upstream end of the drilling shaft 24 by way of a swivel 76. By pulling on the cable 74 as per arrow 78, the drilling shaft 24 and the trepans 30' become in fact traction-driven even as they displace translationally away from the motor driven drill 20.

Therefore, with the boring device D', a cutting action is obtained for translational displacements in both directions of the drilling shaft 24 and of the trepans 30' (see arrows 80), whereby after the removal of each layer of concrete, the drilling shaft 24 and the trepans 30' do not have to be extended away from the drill 20 until reaching the upstream position thereof (i.e. the vertical holes 72) before a new layer can be removed from the concrete work W', as is the case with the boring device D of FIGS. 1 and 2 where the boring action only takes place when the drilling shaft 24 and the trepans 30 are traction driven towards the motor driven drill 20. FIG. 10 shows the downstream annular cutting surfaces 34 of the trepans 30' Of the boring device D' cutting through a layer of concrete in a conventional traction operation (along arrow 82), whereas FIG. 11 illustrates the upstream annular cutting surfaces 69 of the trepans 30' cutting through a layer of concrete in a "reverse traction" operation (along arrow 84) which results from the pulling action of the cable 74 along arrow 78.

It is also noted that the trepans 30' which are diamond-set on both annular vertical surfaces 34 and 69 thereof can be used in one-way cutting operations, such as in FIGS. 1 and 2, as the trepans 30', once one of the annular surfaces 34 or 69 thereof has become worn out, can be reversed on the drilling shaft 24 so as to then cut the concrete with the unused annular surface 69 or 34 of each trepan 30'.

Figure 12:
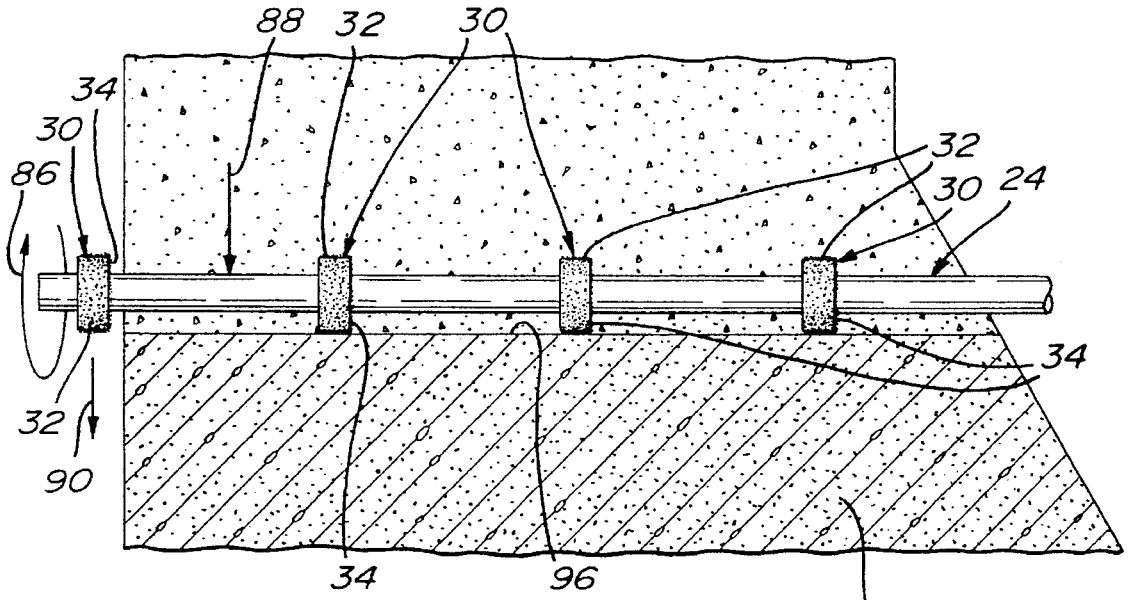
FIG. 12 is a schematic cross-sectional elevational view of some of the components of the multiple trepan traction boring devices of FIGS. 1, 2, 10 and 11 and showing the drilling shaft and the trepans thereof in position on the concrete dam prior to the removal by boring of a new layer therefrom under the rotation of the trepans which are also downwardly forced into the new layer.
Figure 13:
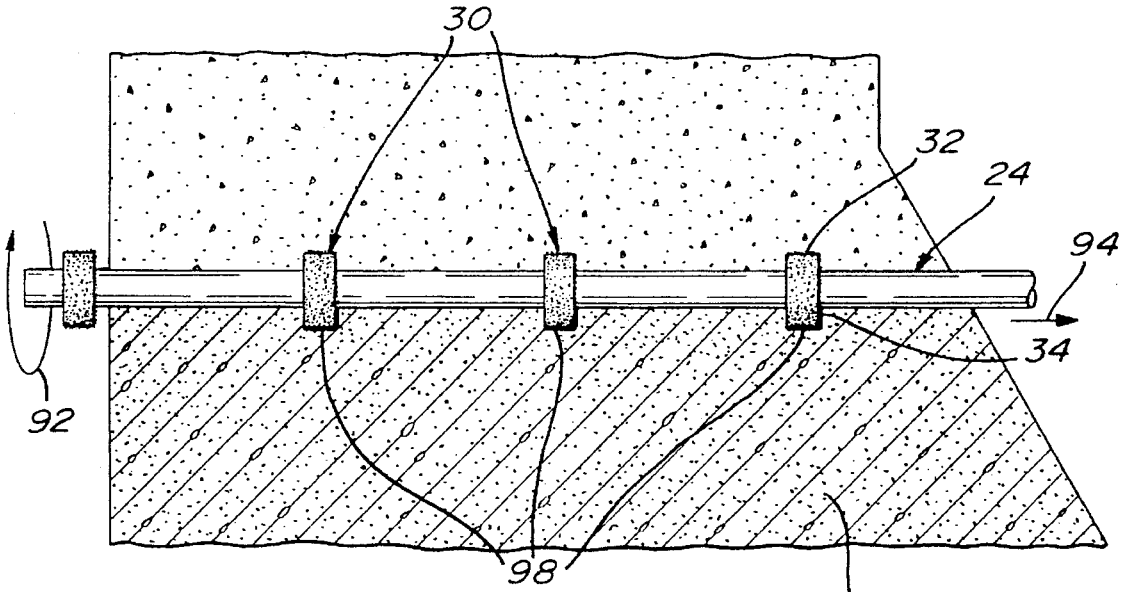
FIG. 13 is a schematic cross-sectional elevational view similar to that of FIG. 12 but showing the drilling shaft and the trepans in lower positions thereof resulting from the downward boring of FIG. 12 and in position to be translationally displaced for removing the new layer from the concrete dam.

FIGS. 1, 2, 10 and 11 all illustrate the trepans 30,30' of the boring devices D,D' during the course of cutting a horizontal layer of concrete, that is at intermediate locations of the horizontal travel thereof. To better illustrate the sequence of the cutting operation of a layer, reference is made to FIGS. 12 and 13 which are schematic representations of the boring devices D,D', wherein some of the components thereof are not illustrated for clarity purposes, e.g. the bushings 36, the weights 40 and the weight stabilizer and guide 42, although all of these components are in reality present on the boring devices of FIGS. 12 and 13. FIG. 12 shows the boring device D,D' in position just prior to the cutting of a new layer from the concrete work W and, more particularly, after one layer has been removed therefrom (and after, in the case of the one-way boring device D, the boring device has been repositioned at a beginning-of-travel position). At the position shown in FIGS. 12, the drilling shaft 24 and the trepans 30,30' of the boring device D,D' are rotated along arrow and without displacing these components in translation and the drilling shaft 24 is initially spaced apart from a top surface 96 of the layer to be removed by a distance corresponding to the difference in radii between the drilling shaft and the trepans 30,30'. The forces exerted parallelly to arrow 88 by the weights 40 (not herein shown for above reasons) cause the peripheral surfaces 32 of the trepans 30,30' to bore downwardly into the concrete work W along arrow 90. The end result of the vertical boring operation of FIG. 12 is shown in FIG. 13, wherein the drilling shaft 24 rests on the top surface 96 and the lower ends of the trepans 30,30' are received in recesses 98 of crescent-shaped side profile. At that point, the drilling shaft 24 and the trepans 30,30' can be translationally displaced along arrow 94 (while still rotating as per arrow 92) so as to remove a new layer of concrete extending from the top surface 96 downwards for a distance corresponding to the difference in radii between the drilling shaft 24 and the trepans 30,30'.

I claim:

1. A boring device for producing cuts in large works, comprising a drilling shaft, motor means for rotatably driving said drilling shaft, at least one trepan means mounted on said drilling shaft and adapted for rotation therewith, said drilling shaft and said trepan means being adapted to be translationally displaced along a rotational axis thereof, said drilling shaft and said trepan means being positioned in use on a large work to be cut and opposite a location of a cut to be produced by said device, said trepan means being of transverse dimensions greater than said drilling shaft and including cutting means extending outwardly of said drilling shaft and in at least one plane non parallel to said axis, whereby while said drilling shaft and said trepan means are being rotated by said motor means, at least said trepan means can be translationally displaced along said axis such that said cutting means removes a layer means from the large work of a width substantially corresponding to outside transverse dimensions of said cutting means and of a maximum thickness at most equal to a radial distance between said drilling shaft and an outside edge of said cutting means.

2. A boring device as defined in claim 1, wherein said trepan means define a central hole with said drilling shaft extending through said bore, said trepan means including a pair of opposed substantially annular surfaces extending at right angles to said rotational axis and a peripheral surface therebetween, said cutting means being provided on at least a first one of said annular surfaces, said first annular surface corresponding to a leading surface during the translational displacement of said trepan means along the large work such as to produce the cut therein.

3. A boring device as defined in claim 2, wherein pressure exerting means are provided for exerting substantially radial pressure on said drilling towards said location of the cut in the large work thereby maintaining said drilling shaft and said trepan means in position during the cutting of the large work.

4. A boring device as defined in claim 3, wherein said cutting means are provided also on said peripheral surface such that the rotation of said trepan means can dig a recess in the large work with said trepan means being translationnally set, said recess having a maximum depth substantially corresponding to said distance between said drilling shaft and said outside transverse dimensions of said trepan means, whereby said trepan means can be positioned directly radially opposite the large work at said location and in contact therewith and can be rotated in place with said peripheral surface cutting through the large work, assisted by said pressure exerted by said pressure exerting means, until said drilling shaft comes in contact with the large work.

5. A boring device as defined in claim 4, wherein said drilling shaft is provided with more than one said trepan means distributed along said drilling shaft thereby allowing for the cut to be made under a smaller translational displacement of said trepan means.

6. A boring device as defined in claim 5, wherein said cutting means are provided on both said annular surfaces to allow for a cutting action from said trepan means along opposite transitional directions.

7. A boring device as defined in claim 6, wherein said annular and peripheral surfaces are set with diamonds.

8. A boring device as defined in claim 6, wherein said drilling shaft is adapted to translationnally displace with said trepan means along said rotational axis.

9. A boring device as defined in claim 8, wherein said drilling shaft comprises a plurality of shaft sections detachably mounted to one another in coaxial succession.

10. A boring device as defined in claim 6, wherein pulling means are provided for displacing said trepan means along said opposite transitional directions.

11. A boring device as defined in claim 3, wherein said pressure exerting means comprise weights mounted to and along said drilling shaft on a side thereof substantially opposite said location of the cut.

12. A boring device as defined in claim 11, wherein said weights are modular and are adapted to be stacked one atop the other at various locations along said drilling shaft for varying said pressure.

13. A boring device as defined in claim 11, wherein guide means are removably mounted to said weights for maintaining said weights substantially aligned.

14. A boring device as defined in claim 13, wherein said guide means and said weights are at most as large as the cut to be received therein as said drilling shaft and said trepan means produce a deeper cut in the large work.

15. A boring device as defined in claim 14, wherein said guide means and said weights are substantially as large as the cut such as to further guide said drilling shaft when said guide means and said weights are received in the cut.

16. A boring device as defined in claim 13, wherein said weights and said guide means are engaged together with cooperating tongue-and-groove type means with a same guide means being connected to a number of said weights.

17. A boring device as defined in claim 11, wherein said weights are mounted to said drilling shaft by connection means provided with bushing means at said drilling shaft such that said drilling shaft can freely rotate with respect to said weights.

18. A boring device as defined in claim 2, wherein said drilling shaft and said trepan means are hollow for receiving cooling means therein.

19. A boring device as defined in claim 18, wherein opening are defined at least on one of said annular and peripheral surfaces for allowing said cooling means fed into said drilling shaft to exit therefrom.

20. A method for producing cuts in large works, comprising the steps of:

a) positioning a rotatable assembly consisting of a drilling shaft and at least one trepan means mounted on said drilling shaft on a large work and opposite a location of a desired cut such that cutting means of said trepan means extending outwardly of said drilling shaft are at least partly located opposite the work to be cut; and b) displacing said trepan means in translation along a rotational axis thereof while in rotation such that said cutting means removes a layer means from the large work of a width substantially corresponding to outside transverse dimensions of said cutting means and of a maximum thickness at most equal to a radial distance between said drilling shaft and an outside edge of said cutting means.

21. A method as defined in claim 20, wherein step b) is repeated until a cut of desired depth is obtained by removal one-by-one of a number of layers from the large work.

22. A method as defined in claim 21, further comprising, at the beginning of each said layer, the additional step of positioning said trepan means directly radially opposite the large work at said location and in contact therewith and rotating said trepan means in a translationnally set position such as to can dig in the large work a recess for a new layer, said recess having a maximum depth substantially corresponding to said distance between said drilling shaft and said outside transverse dimensions of said trepan means.

23. A method as defined in claim 22, wherein, in step a), said drilling shaft is provided with more than one said trepan means distributed along said drilling shaft thereby allowing for the cut to be made under a smaller translational displacement of said trepan means.

24. A method as defined in claim 21, wherein said cutting means are adapted to allow said trepan means to cut through the large work alternately along two opposite transitional directions parallel to said rotational axis.

* * * * *